US009962988B2

(12) United States Patent
Springmann

(10) Patent No.: US 9,962,988 B2
(45) Date of Patent: May 8, 2018

(54) DATA PAGE FOR A SECURITY DOCUMENT AND/OR VALUE DOCUMENT

(71) Applicant: Bundesdruckerei GmbH, Berlin (DE)

(72) Inventor: Edward Springmann, Berlin (DE)

(73) Assignee: BUNDESDRUCKEREI GMBH, Berlin (DE)

( * ) Notice: Subject to any disclaimer, the term of this patent is extended or adjusted under 35 U.S.C. 154(b) by 87 days.

(21) Appl. No.: 14/898,418

(22) PCT Filed: Apr. 10, 2014

(86) PCT No.: PCT/DE2014/000184

§ 371 (c)(1),
(2) Date: Dec. 14, 2015

(87) PCT Pub. No.: WO2014/198246

PCT Pub. Date: Dec. 18, 2014

(65) Prior Publication Data

US 2016/0144651 A1 May 26, 2016

(30) Foreign Application Priority Data

Jun. 12, 2013 (DE) ..... 10 2013 009 800

(51) Int. Cl.
*B42D 25/45* (2014.01)
*B42D 25/455* (2014.01)
(Continued)

(52) U.S. Cl.
CPC ..... *B42D 25/45* (2014.10); *B42D 1/002* (2013.01); *B42D 1/007* (2013.01); *B42D 13/00* (2013.01);
(Continued)

(58) Field of Classification Search
CPC ..... B42D 25/24; B42D 25/45; B42D 25/455; B42D 25/46
See application file for complete search history.

(56) References Cited

U.S. PATENT DOCUMENTS

2005/0202249 A1* 9/2005 Iliescu ..... B42D 25/45 428/412
2011/0278830 A1* 11/2011 Brunner ..... B42D 25/29 281/15.1
(Continued)

FOREIGN PATENT DOCUMENTS

CA 2529029 C * 2/2012 ..... B42D 25/45
EP 1008459 A1 6/2000
(Continued)

*Primary Examiner* — Kyle Grabowski
(74) *Attorney, Agent, or Firm* — Mayer & Williams PC; Stuart H. Mayer

(57) ABSTRACT

A method for producing a book-like security and/or value document includes: A) at least two layers of a data sheet formed from organic polymeric materials are brought together, one inner layer having smaller dimensions than at least one adjacent layer, the data sheet forming a gap or a step along an edge, the gap/step being filled with an auxiliary piece having a thickness which substantially corresponds to the thickness of the inner layer and formed from a material which is not laminable with the at least two layers, B) all layers of the stack of step A) are laminated with each other, not with the auxiliary piece, C) auxiliary piece is removed, D) a data sheet region of a cover tab is introduced into the gap/step and connected with the data sheet, E) a cover region of the cover tab is bound into the cover of the security and/or value document.

13 Claims, 3 Drawing Sheets

(51) Int. Cl.

| | |
|---|---|
| ***B42D 25/46*** | (2014.01) |
| ***B42D 25/24*** | (2014.01) |
| ***B42D 1/00*** | (2006.01) |
| ***B42D 13/00*** | (2006.01) |
| ***B42D 25/00*** | (2014.01) |

(52) U.S. Cl.
CPC ..... *B42D 25/00* (2014.10); *B42D 25/24* (2014.10); *B42D 25/455* (2014.10); *B42D 25/46* (2014.10); *B42D 2033/40* (2013.01)

(56) References Cited

U.S. PATENT DOCUMENTS

| | | | | |
|---|---|---|---|---|
| 2012/0319394 | A1* | 12/2012 | Christen | B42D 25/425 283/63.1 |
| 2014/0265295 | A1* | 9/2014 | Rhyner | B42D 25/465 281/38 |
| 2014/0265301 | A1* | 9/2014 | Haas | B42D 25/45 283/85 |

FOREIGN PATENT DOCUMENTS

| | | | | |
|---|---|---|---|---|
| EP | 2116390 | A2 | 11/2009 | |
| FR | 2946567 | A1 | 12/2010 | |
| WO | 2007114700 | A1 | 10/2007 | |
| WO | WO 2013058374 | A1 * | 4/2013 | B42D 25/24 |

* cited by examiner

DATA PAGE FOR A SECURITY DOCUMENT AND/OR VALUE DOCUMENT

FIELD OF THE INVENTION

The invention relates to a method for producing a book-like security and/or value document comprising the following method steps: at least two layers of a data sheet formed from organic polymeric materials are brought together, one layer having smaller dimensions than at least one adjacent layer, and wherein a data sheet region of a cover tab is bound in the region of the data sheet of smaller dimensions, a cover region of the cover tab is bound into the cover of the security and/or value document. The invention further relates to a security and/or value document obtainable by such method.

BACKGROUND OF THE INVENTION AND PRIOR ART

Data sheets employed in the context of the invention are typically contained in book-like documents. In the context of the invention, the term "book form" also includes booklets, with a number of pages or sheets in the range from 1 to 50, typically from 5 to 40. These documents may include only one data sheet or a plurality of such data sheets, which normally (but not necessarily) are arranged between two book covers (hard or flexible). Together with the data sheet, further data sheets different therefrom, for instance based on paper materials, may be included. Such a document is for instance a passport, but also any other documents of this configuration may be comprised.

Such data sheets typically carry information, at least in part individualized and/or personalized. Individualized means, with respect to a document, e.g., a serial number. Personalized means, with respect to a document, e.g., a name or picture. Furthermore, in such a data sheet may be integrated security features. All conventional security features are included, which typically can be employed as a data sheet for plastic laminates.

A book-like document using a textile fabric as a tab or hinge is known from the document US 2008/0284155 A1. A booklet-type document with a textile core layer, however with an expensive thermoplastic plastic layer is known from document EP 1812244. A passport with a plasticized data page and using a fleece strip as a kinking/folding edge is known from the document EP 2116390.

It is disadvantageous, in the insofar known production methods, that during production of the data sheet the cover tab is already integrated in the data sheet. Further, for the simultaneous lamination of the cover tab during the lamination process of the layers of the data sheet, the selection of the materials for the cover tab is limited. This applies in particular to variants, in which the data sheet region of the cover tab is formed by a complete layer in the lamination composite of the data sheet. In some known production methods, further, data sheets are obtained, where the integrated or applied cover tab adds to the height or leads to portions adding to the height of the data sheet.

TECHNICAL OBJECT OF THE INVENTION

It is therefore the technical object of the invention to specify a method for producing a book-like security and/or value document, wherein the selection of the cover tab material is relatively free, the obtained data sheet includes no portions adding to the height, and a separation of the production of the data sheet from the integration of the tab is possible.

BASICS OF THE INVENTION AND PREFERRED EMBODIMENTS

For achieving this technical object, the invention teaches a method for producing a book-like security and/or value document comprising the following method steps: A) at least two layers of a data sheet formed from organic polymeric materials are brought together, one layer having smaller dimensions than at least one adjacent layer, the step of bringing together being carried out with the proviso that the data sheet forms a gap or a step along an edge, the gap or the step being filled with an auxiliary piece having a thickness which substantially corresponds to the thickness D1 of the inner layer of smaller dimensions, the auxiliary piece being formed from a material which is not laminable with the layers, B) the stack of step A) is subjected to a lamination step, all layers being laminated with each other, not however with the auxiliary piece, C) the auxiliary piece is removed, D) a data sheet region of a cover tab is introduced into the gap or into the step of the data sheet and connected with the data sheet in a form-fit, force-fit, or material-fit fashion, E) a cover region of the cover tab is bound into the cover of the security and/or value document.

By a method according to the invention, it is achieved, first, that the production of the data sheet can occur completely independently (and before) the integration of the cover tab in the data sheet. This considerably simplifies the production of the data sheet. Moreover, the method according to the invention allows a nearly free selection of the material of the cover tab, as in addition to the material-fit integration of the cover tab in the data sheet, purely mechanical (form-fit and/or force-fit) methods, such as sewing, riveting etc. are possible. In any case, a safe and stable connection between data sheet and cover tab is guaranteed. Finally, a data sheet with an integrated cover tab is obtained, which nevertheless nowhere has portions adding to the height.

Specifically, the method according to the invention can be carried out in two variants having an independent significance. First, at least three layers of the data sheet may be brought together, with the layer of smaller dimensions being an inner layer is, thereby a gap being formed, and wherein the gap preferably has a gap width which substantially corresponds to the thickness D2 of the data sheet region of the cover tab, in particular in the range from 50 to 2,000 μm, preferably 200 to 1,000 μm. Second, at least two layers of the data sheet may be brought together, the layer of smaller dimensions being an outer layer, thereby a step being formed, and wherein the step preferably has a step height which substantially corresponds to the thickness D2 of the data sheet region of the cover tab, in particular in the range from 50 to 2,000 μm, preferably 200 to 1,000 μm.

In the first case, the auxiliary piece is located between two layers, thereby the gap being formed. In the second case, the auxiliary piece is located between a layer and a lamination plate of a lamination device.

In principle, the auxiliary piece may be formed from any material which does not enter into a material fit with the following layers during lamination. For instance, the auxiliary piece may be formed from a metal band or a coated plastic tape. In the latter case, it is a coating, which is inert with respect to the material of the layers during lamination.

The auxiliary piece may be geometrically configured in different ways. On the one hand, it may by flush with an external edge of the layer stack. Alternatively, it may project beyond this external edge. In principle, the auxiliary piece, in both variants, may be removed immediately after lamination or only after an edge cutting step following lamination. The latter is preferred, as then a more precise edge cutting is achieved.

The connection of data sheet and data sheet region of the cover tab may occur in any conventional manner. Form-fit connections comprise for instance sewing or riveting. Therein, a thread or a rivet is incorporated such that they span the data sheet region of the cover tab together with adjacent layers and thus fix the data sheet region in the gap or in the step. Material-fit connections include gluing or welding with adjacent layers. Preferably, the connection of data sheet and data sheet region of the cover tab occurs by means of plastic welding, in particular ultrasonic welding between two sonotrodes.

The depth T of the gap or step relative to the external edge of the data sheet is not critical, has however preferably a value from 0.5 to 20 mm, in particular 1 to 10 mm.

Organic polymeric materials of the data sheet include those selected from the group consisting of PC (polycarbonate, in particular bisphenol A polycarbonate), PET (polyethylene terephthalate), PMMA (polymethyl methacrylate), TPU (thermoplastic polyurethane elastomers), PE (polyethylene), PP (polypropylene), PI (polyimide or poly-trans-isoprene), PVC (polyvinyl chloride), polystyrene, polyacrylates and methacrylates, vinyl ester, ABS and copolymers of such polymers, cycloolefin copolymers, polysulfones, polyester, PET, PEN, polycarbonate/polyester blends, e.g. PC/CoPET, polycarbonate/poly(cyclohexyl methanol cyclohexane dicarboxylate), in particular polycarbonates or copolycarbonates based on diphenols, poly- or copolyacrylates, poly- or copolymethacrylates, poly- or copolymers with styrene, thermoplastic polyurethanes, polyolefins, poly- or copolycondensates of the terephthalic acid or naphthalene dicarboxylic acid or mixtures thereof, particularly preferred polycarbonates or copolycarbonates based on diphenols, poly- or copolyacrylates, poly- or copolymethacrylates, poly- or copolycondensates of the terephthalic acid or naphthalene dicarboxylic acid or mixtures or copolymers thereof.

In principle, all conventional materials can be used for the cover tab, for instance the above materials of the layers, but also textiles, for instance configured as a fabric, a woven fabric, a knitted fabric, a braid, a stitchbonded fabric, a non-woven fabric, a felt, an areal roving, a fiber network or an areal fiber arrangement. In the latter case, it may be recommended, in particular in the case of the material-fit connection between the data sheet region of the cover tab, if the textile is coated and/or soaked in the data sheet region and/or the cover region and/or overall with an organic binder on one or both sides, wherein the binder preferably is thermally weldable and/or gluable with the material of a layer of the data sheet overlapping with the cover tab. Before introducing the data sheet region of the cover tab, the binder may be cured, or after introducing for instance during lamination.

Generally, it is noted that every layer can be formed from different sub-layers, which were connected to each other either before collating the layers, or which are connected to each other only during lamination so to form a layer.

Finally, the invention teaches a security and/or value document obtainable by a method according to the invention.

BRIEF DESCRIPTION OF THE DRAWINGS

In the following, the invention is explained in more detail with reference to figures illustrating an embodiment only. There are.

DETAILED DESCRIPTION

Figure 1:
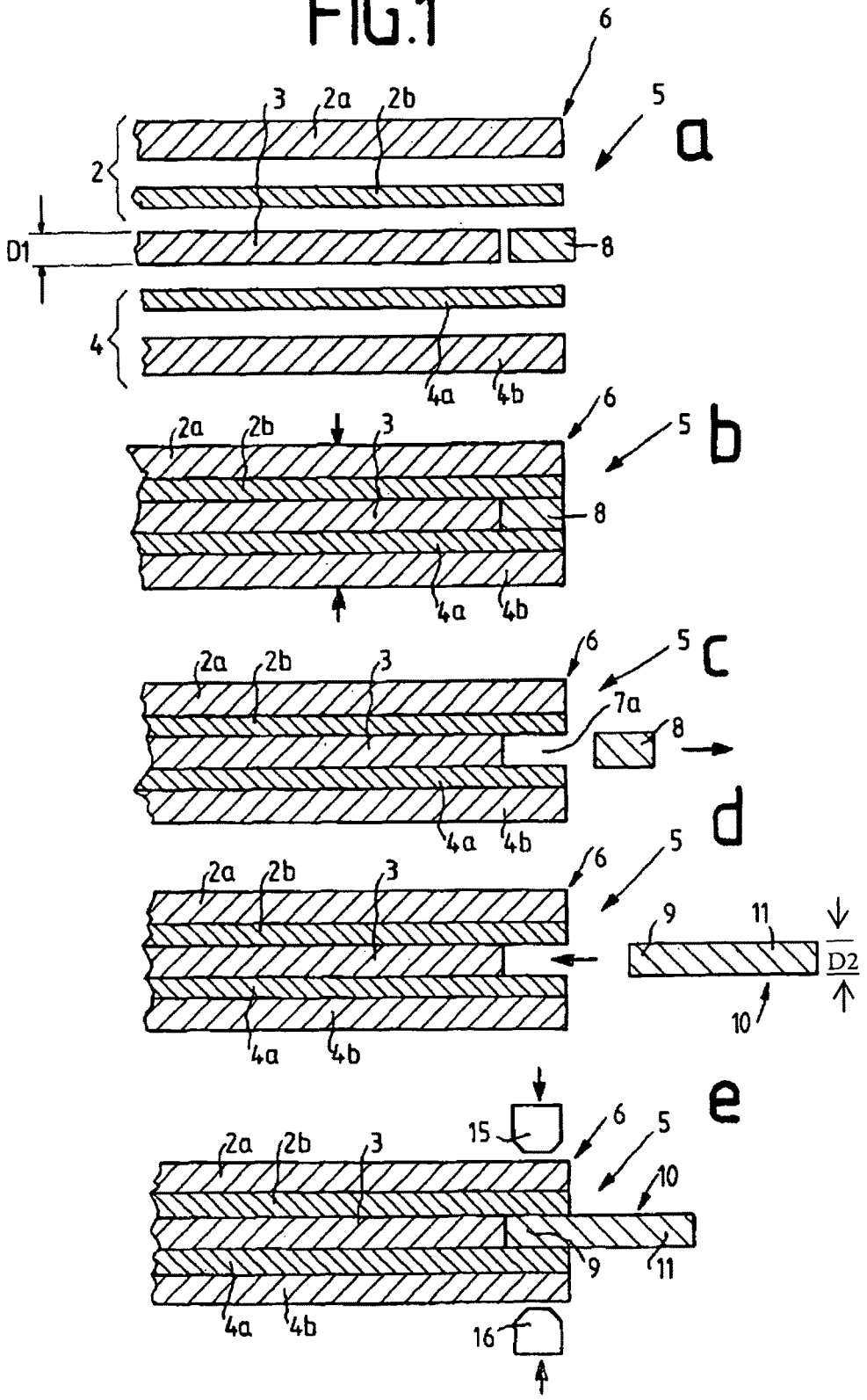
FIG. 1*a-e*: a method according to the invention for producing a data sheet with introduced cover tab.

In FIG. 1 is shown a first alternative of the production according to the invention of a data sheet 5. Three layers 2, 3, 4 of a data sheet 5 formed from organic polymeric materials are brought together, wherein a layer 3 has smaller dimensions relative to at least one adjacent layer 2, 4 (FIG. 1*a*). In the example, layers 2, 4 consist of two layers 2*a/b* and 4*a/b* each. Bringing-together occurs with the proviso that the data sheet 5 forms a gap 7*a* or a step 7*b* along an edge 6, wherein the gap 7*a* or the step 7*b* is filled with an auxiliary piece 8 having a thickness, which substantially corresponds to the thickness D1 of the inner layer 3 of smaller dimensions (FIG. 1*a*). The auxiliary piece 8 is formed from a material which is not laminable with the layers 2, 3, 4. The stack thus obtained is subjected to a lamination step, wherein all layers 2, 3, 4 are laminated with each other, not however with the auxiliary piece 8 (1*b*). Lamination occurs by means of the lamination plates heated in a conventional manner and pressed with a given pressure against each other. After lamination, the auxiliary piece 8 is removed (1*c*). A data sheet region 9 of a cover tab 10 is introduced into the gap 7*a* of the data sheet 5 (1*d*) and is then connected with the data sheet 5 in a form-fit, force-fit, or material-fit manner, in the embodiment by means of sonotrode welding with the sonotrodes 15, 16. Finally, a cover region 11 of the cover tab 10 is bound into the cover 12 of the security and/or value document 1, for instance by means of sewing.

In particular from FIGS. 1*a* to 1*d* can b e taken that the gap 7*a* preferably has a gap width which substantially corresponds to the thickness D2 of the data sheet region 9 of the cover tab 10.

Figure 2:
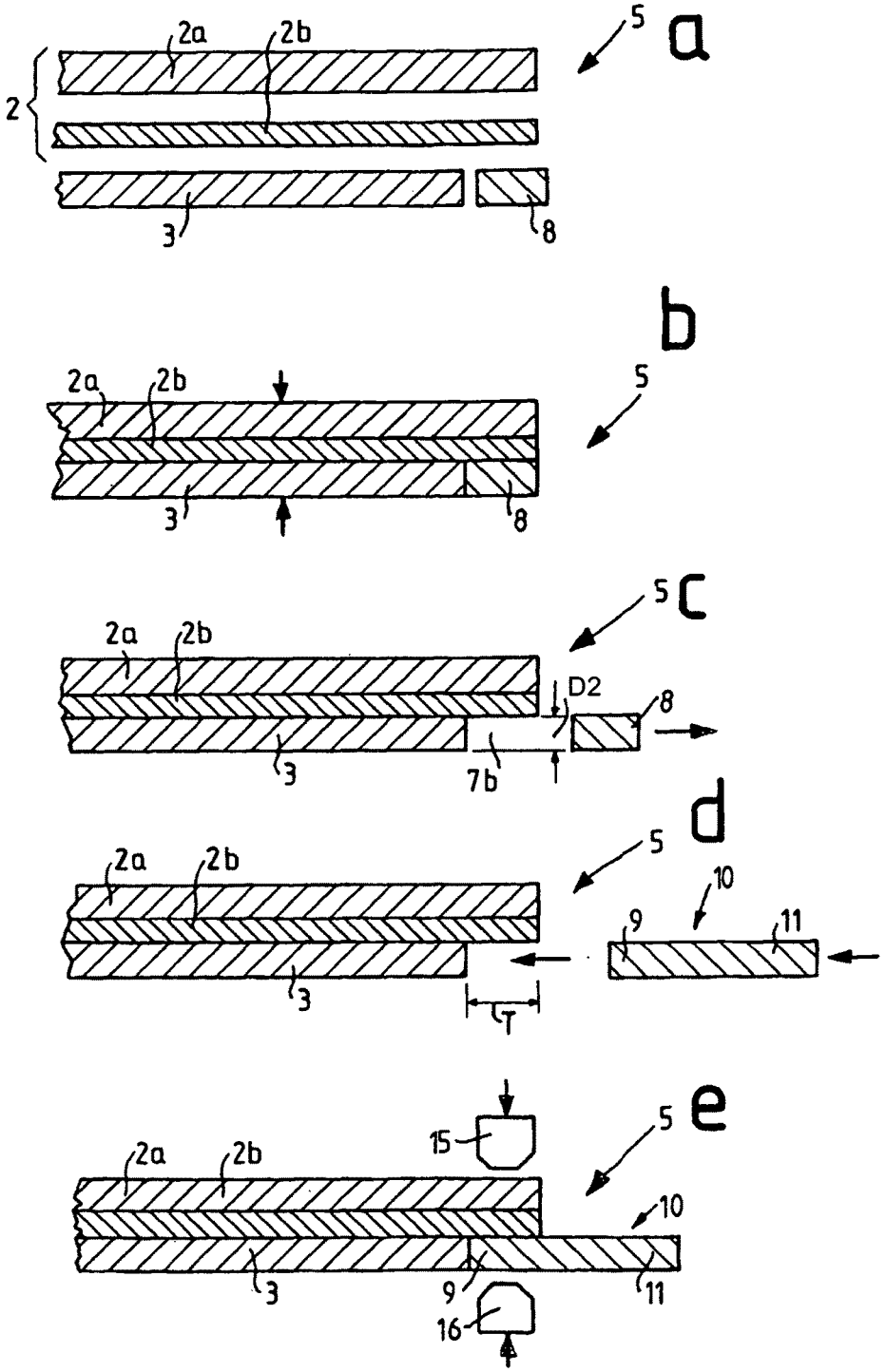
FIG. 2*a-e*: an alternative method according to the invention for producing a data sheet with introduced cover tab.

In the embodiment of FIG. 2, the procedure is quite analogous, except that there is no outer layer 4 and thus a step 7*b* is formed. Other than that, the above steps apply in an analogous manner, with the steps of FIGS. 2*a* to 2*e* corresponding to those of steps 1*a* to 1*e*. Basically, here are brought together just two layers (2, 3) of the data sheet (5), with the layer (3) of smaller dimensions being an outer layer and thereby step (7*b*) being formed. Step (7*b*) preferably has a step height, which substantially corresponds to the thickness D2 of the data sheet region (9) of the cover tab (10).

In the two embodiments of FIGS. 1 and 2, the auxiliary piece (8) is formed from a coated plastic tape, the coating being formed from a material being incompatible with the material of the layers 2, 3, 4.

Further, it can be taken from FIGS. 1 and 2 that the depth T of the gap (7*a*) or of the step (7*b*) has a value from 0.5 to 20 mm, in particular 1 to 10 mm, relative to the edge (6) of the data sheet (5).

As an organic polymeric material for the layers 2, 3, 4, for instance PC (polycarbonate, in particular bisphenol A polycarbonate) may be used.

As a material for the cover tab (10), for instance, a textile, a fabric, a woven fabric, a knitted fabric, a braid, a stitch-bonded fabric, a non-woven fabric, a felt, an areal roving, a fiber network or an areal fiber arrangement may be used. The textile may be soaked with an organic binder, for instance based on PC (completely or just in the data sheet region 9), thereby the binder being thermally weldable and/or gluable with the material of a layer 2, 4 of the data sheet 5 overlapping with the cover tab 10. The binder may be cured before introducing into the gap 7*a* or the step 7*b*.

Figure 3:
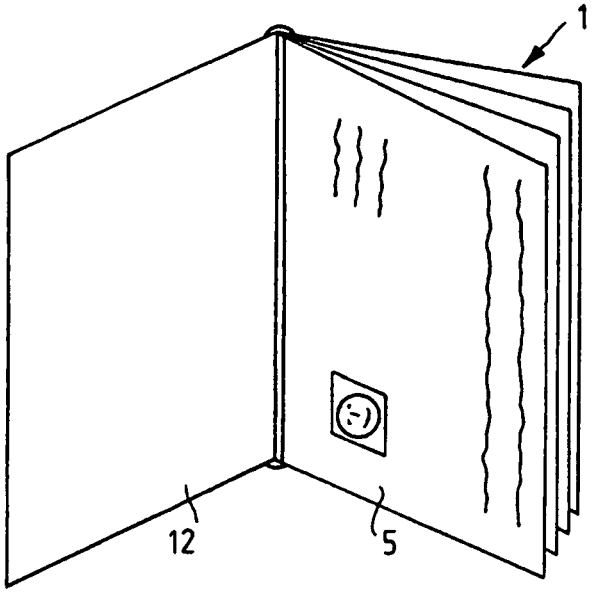
FIG. 3: a security and/or value document produced according to the invention.

In FIG. 3 can be seen that a data sheet 5 obtained according to one of FIG. 1 or 2 has been bound into a cover 12 of the security and/or value document 1.

The invention claimed is:

1. A method for producing a book-like security and/or value document comprising the following method steps:

A) bringing together at least two layers of a data sheet formed from organic polymeric materials, one layer having smaller dimensions than at least one adjacent layer, the step of bringing together being carried out with the proviso that the data sheet forms a gap or a step along an edge, the gap or the step being filled with an auxiliary piece having a thickness which substantially corresponds to the thickness D1 of the layer of smaller dimensions, the auxiliary piece being formed from a material which is not laminable with the layers, B) subjecting the stack of step A) to a lamination step, all layers being laminated with each other, not however with the auxiliary piece C) removing the auxiliary piece, D) introducing a data sheet region of a cover tab into the gap or into the step of the data sheet and connected with the data sheet in a form-fit, force-fit, or material-fit fashion, and E) binding a cover region of the cover tab into the cover of the security and/or value document.

2. A method according to claim 1, wherein at least three layers of the data sheet are brought together, the layer of smaller dimensions being an inner layer, thereby a gap being formed, and wherein the gap has a gap width which substantially corresponds to the thickness D2 of the data sheet region of the cover tab.

3. A method according to claim 2, wherein the gap width which substantially corresponds to the thickness D2 of the data sheet region of the cover tab is in the range from 200 to 1,000 μm.

4. A method according to claim 1, wherein two layers of the data sheet are brought together, the layer of smaller dimensions being an outer layer, thereby a step being formed, and wherein the step has a gap width which substantially corresponds to the thickness D2 of the data sheet region of the cover tab.

5. A method according to claim 4, wherein the gap width which substantially corresponds to the thickness D2 of the data sheet region of the cover tab.

6. A method according to claim 1, wherein the auxiliary piece is formed from a metal band or a coated plastic tape.

7. A method according to claim 1, wherein the connection of data sheet and data sheet region of the cover tab occurs by means of plastic welding.

8. A method according to claim 1, wherein the cover region of the cover tab is sewn or glued into the cover.

9. A method according to claim 1, wherein a depth T of the gap or of the step relative to the edge of the data sheet has a value from 0.5 to 20 mm.

10. A method according to claim 1 wherein the organic polymeric material of the data sheet is selected from the group consisting of PC (polycarbonate, in particular bisphenol A polycarbonate), PET (polyethylene terephthalate), PMMA (polymethyl methacrylate), TPU (thermoplastic polyurethane elastomers), PE (polyethylene), PP (polypropylene), PI (polyimide or poly-trans-isoprene), PVC (polyvinyl chloride), polystyrene, polyacrylate and methacrylate, vinyl ester, ABS and copolymers of such polymers, cycloolefin copolymers, polysulfones, polyester, PET, PEN, polycarbonate/polyester blends, e.g. PC/coPET, polycarbonate/poly/cyclohexyl methanol cyclohexane dicarboxylate).

11. A method according to claim 1, wherein the cover tab is formed from a material selected from the group consisting of PC (polycarbonate, in particular bisphenol A polycarbonate), PET (polyethylene terephthalate), PMMA (polymethyl methacrylate), TPU (thermoplastic polyurethane elastomers), PE (polyethylene), PP (polypropylene), PI (polyimide or poly-trans-isoprene), PVC (polyvinyl chloride), polystyrene, polyacrylate and methacrylate, vinyl ester, ABS and copolymers of such polymers, cycloolefin copolymers, polysulfones, polyester, PET, PEN, polycarbonate/polyester blends, e.g. PC/coPET, polycarbonate/poly/cyclohexyl methanol cyclohexane dicarboxylate).

12. A method according to claim 11, wherein the textile is a fabric, a woven fabric, a knitted fabric, a braid, a stitch-bonded fabric, a non-woven fabric, a felt, an areal roving, a fiber network or an areal fiber arrangement.

13. A method according to claim 11, wherein the textile is coated and/or soaked in the data sheet region and/or in the cover region and/or overall on one or both sides with an organic binder, wherein the binder is thermally weldable and/or gluable with the material of a layer of the data sheet overlapping with the cover tab.

* * * * *